US005763990A

United States Patent [19]

Kwak

[11] Patent Number: 5,763,990

[45] Date of Patent: Jun. 9, 1998

[54] ASSEMBLY OF MASK FRAME AND INNER SHIELD FOR COLOR CATHODE-RAY TUBES

[75] Inventor: Jong-seop Kwak, Kyungsangbok-do, Rep. of Korea

[73] Assignee: Samsung Display Devices Co., Ltd., Kyungki-do, Rep. of Korea

[21] Appl. No.: 640,171

[22] Filed: Apr. 30, 1996

[30] Foreign Application Priority Data

Sep. 25, 1995 [KR] Rep. of Korea ..... 1995-25991

[51] Int. Cl.[6] ..... H01J 29/06

[52] U.S. Cl. ..... 313/402; 313/326; 313/352

[58] Field of Search ..... 313/402, 407, 313/404, 239, 326, 352, 240, 242, 313; 174/35 MS

[56] References Cited

U.S. PATENT DOCUMENTS

| | | | |
|---|---|---|---|
| 3,376,451 | 4/1968 | Mears | 313/313 |
| 4,678,963 | 7/1987 | Fonda | 313/407 |
| 4,694,216 | 9/1987 | Morrell | 313/402 |
| 5,103,132 | 4/1992 | Van Der Bolt et al. | 313/402 |

*Primary Examiner*—George M. Dombroske
*Assistant Examiner*—Harshad Patel
*Attorney, Agent, or Firm*—Christie, Parker & Hale, LLP

[57] ABSTRACT

An assembly of mask frame and inner shield for color cathode-ray tubes is disclosed, including a mask frame which is attached toward a panel so as to improve initial doming characteristics, decrease correction capacity of the spring, and prevent unbalanced magnetic field induction to the inside. An inner shield which is attached in opposition to the mask frame and protects electron beams from the earth's magnetic field, a mask frame assembly which contains the mask frame, and the inner shield. The mask frame has a band type with only side and a plate for preventing random reflection provided in the side of the inner shield. The plate for preventing random reflection is formed in a single body together with the inner shield. The inner shield is assembled inside or outside of the mask frame. The plate for preventing random reflection is extended from the inner shield to the inside at the front end or rear end of the mask frame.

5 Claims, 4 Drawing Sheets

ASSEMBLY OF MASK FRAME AND INNER SHIELD FOR COLOR CATHODE-RAY TUBES

BACKGROUND

The present invention relates to an assembly of mask frame and inner shield for color cathode-ray tubes and, more particularly, to an assembly of the mask frame and the inner shield which improves initial doming characteristics by diminishing thermal capacity, and realizes cost reduction.

On the inside of a panel of the color cathode-ray tube, a shadow mask is provided so that it allows electron beams to land on a phosphor layer according to color separation of the beams emitted from an electron gun.

The shadow mask is attached by welding, and other methods, at the mask frame which is thicker than the shadow mask. It is opposed to the inner face of the panel. At the position opposed to the shadow mask, the inner shield is provided and it protects electron beams from the earth's magnetic field so that the course of the electron beam can not be changed.

FIGS. 6 and 7 illustrate prior mask frame assembly, respectively MIFA type and MOFA type.

The assembly of MIFA is of the type that a skirt part of the shadow mask 4 is attached to the inside of the mask frame 2. The assembly of MOFA is of the type that a skirt part of the shadow mask 4 is attached to the outside of the mask frame 2.

The assembly of the MIFA type has a smaller aperture area of the shadow mask 4 than that of MOFA type under the same condition.

The mask frame 2 has a horizontal side 8 which makes a right angle with the side 6. The horizontal side 8 is used to protect random reflections of electron beams, which are emitted from the electron gun to a phosphor screen.

The inner shield 10, intercepting the earth's magnetic field, is attached by using a clip on the horizontal side 8.

The mask frame assembly with the above structure increases the thermal capacity because the thick mask frame 2 includes the side 6 and the horizontal side 8. This proves to be problematic.

Accordingly, the mask frame assembly must increase correction capacity of the spring that supports the mask frame because it is not good in initial doming characteristics and gradually increases in thermal expansion capacity.

In addition, as the horizontal side 8 gives rise to an unbalanced magnetic field, the characteristic of the magnetic field worsens and the cathode-ray tube increases as much as the horizontal side in weight. Accordingly the cathode-ray tube increases in total weight.

SUMMARY

The present invention is made in an effort to solve the problem described above. It is an object of the invention to provide the assembly of a mask frame and inner shield for color cathode-ray tubes which are made to respond quickly in order to minimize the thermal capacity of the mask frame, decrease correction capacity supporting the mask frame, and decrease the whole size of the cathode-ray tube.

It is another object of the invention to provide the assembly of a mask frame and inner shield for color cathode-ray tubes which can remove the unbalanced magnetic field caused by the horizontal side.

In order to achieve the above object, the assembly of the mask frame and inner shield for color cathode-ray tubes supplies the mask frame assembly including the mask frame, to which the shadow mask is attached toward the panel and the inner shield, which is in turn attached opposite to the mask frame, and protects electron beams from the earth's magnetic field.

The assembly of the mask frame and inner shield for color cathode-ray tubes supplies the above mask frame of a band type which has only side and the above inner shield, which has an inwardly directed plate for preventing random reflection.

Also, the assembly of the mask frame and inner shield for color cathode-ray tubes supplies the plate for preventing random reflection which is formed with a single body together with the inner shield.

In addition, the assembly of the mask frame and inner shield for color cathode-ray tubes supplies the inner shield which is assembled inside or outside of the mask frame.

And finally, the assembly of the mask frame and inner shield for color cathode-ray tubes supplies the plate for preventing random reflection which is extended from the inner shield to the inside at the front or rear end of the mask frame.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DESCRIPTION

A preferred embodiment of the present invention will now be described in detail with reference to the accompanying drawings.

Figure 1:
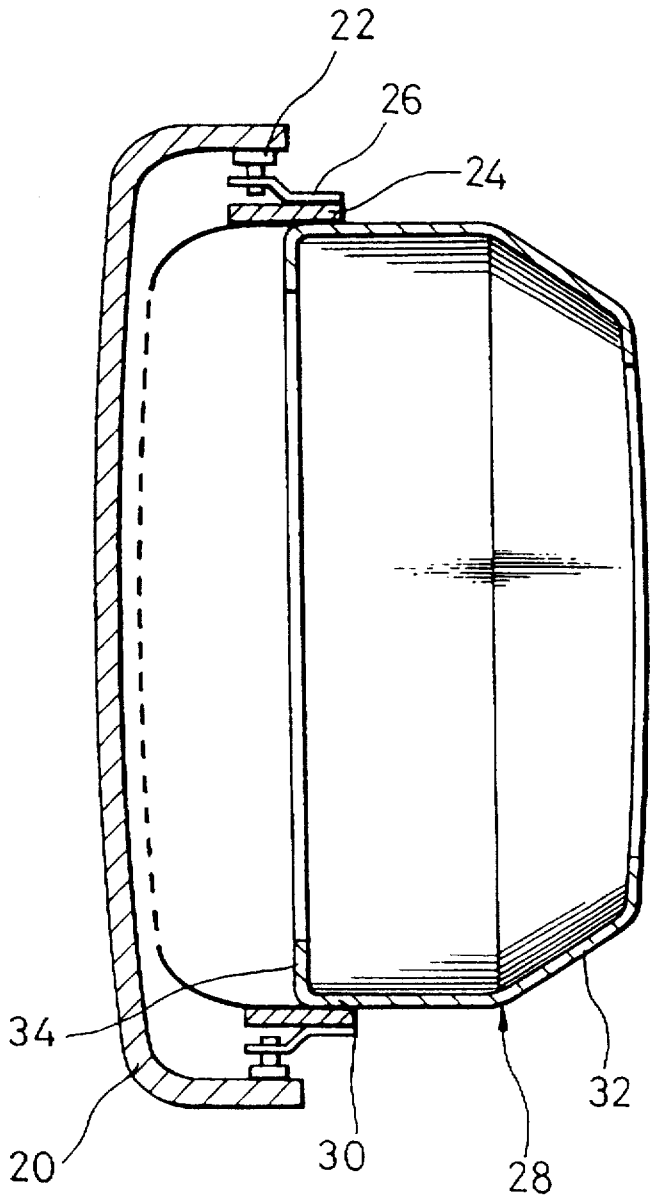
FIG. 1 is a side-sectional view of a main part for a cathode-ray tube according to a first preferred embodiment of the invention.

FIG. 1 is a side-sectional view of an assembly of a mask frame and an inner shield according to a preferred embodiment of the invention. The mask frame is suspended through a stud pin 22 which is partly stuck in the inside of the panel 20.

For practical purposes, a bimetal spring 26 is attached on the mask frame 24 and a front side of the spring is suspended by the stud pin 22.

Figure 3:
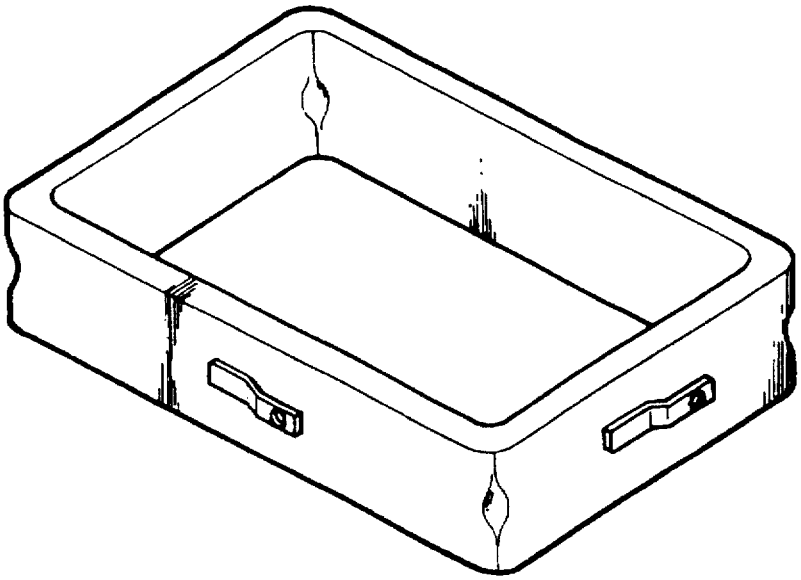
FIG. 3 is a perspective view of a mask frame according to a preferred embodiment of the invention.

As illustrated in FIG. 3, the mask frame 24 is a frame of a band type without a horizontal side, and the spring is suspended as above.

It is desirable that the band has a thickness of more than 2 mm. Though not illustrated, the band can be beaded or embossed for high structural intensity.

The mask frame 24 provides the inner shield with the preventive means which replaces its function by removing structurally the horizontal side.

The inner shield 28 is similar to the prior art in that it includes an incline 32 and a side 30 placed before and behind, right and left. But the inner shield 28 contains a plate 34 at the front of side 30, to prevent random reflection.

The thickness of the plate 34 for preventing random reflection can be manufactured with the same thickness as the inner shield.

The plate 34 for preventing random reflection is manufactured in a single body together with the inner shield. Or it can be manufactured so that it is attached by another clip to the inside of the mask frame 24.

Figure 2:
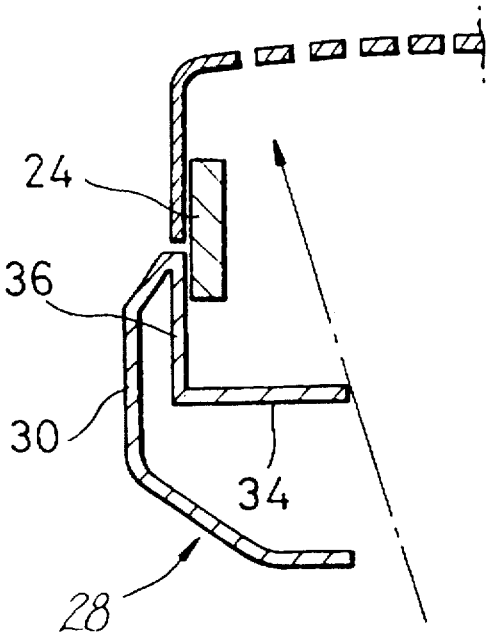
FIG. 2 is a sectional view of a panel part according to a second preferred embodiment of the invention.

FIGS. 1 and 2, respectively, illustrate the MIFA and MOFA types.

According to the applicable example, the end of the side 30 of the inner shield 28 is folded from its side 30 end to the inside in a state of opposition to the inside, thereby extending an attaching plate 36. The plate 34 for preventing random reflection is oriented so that it extends from the attaching plate toward the inside of the inner shield 28.

As illustrated in FIGS. 1 and 2, the plate 34 for preventing random reflection of the inner shield 28 is placed at the rear-end side of the mask frame 24 and limits the path of electron beams.

Figure 4:
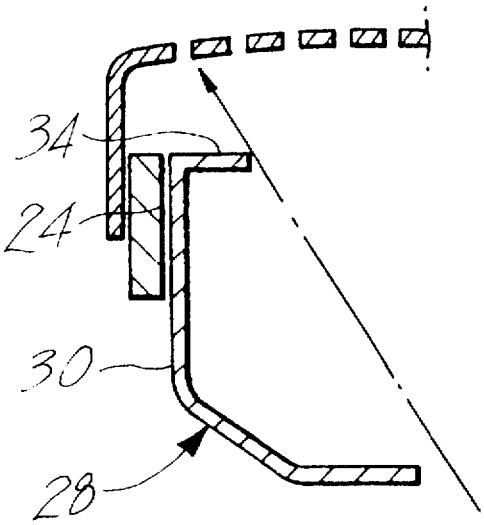
FIG. 4 is a side-sectional view of an assembly according to a third preferred embodiment of the invention.
Figure 5:
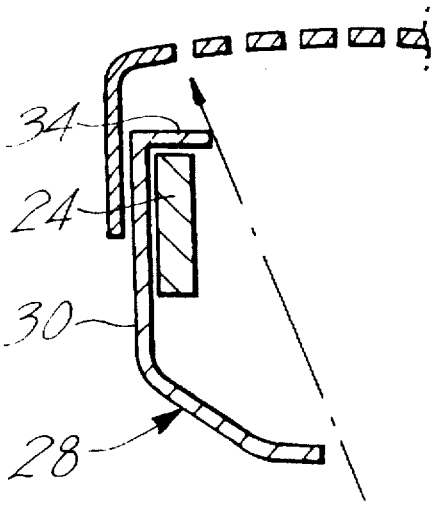
FIG. 5 is a side-sectional view of an assembly according to a fourth preferred embodiment of the invention.
Figure 6:
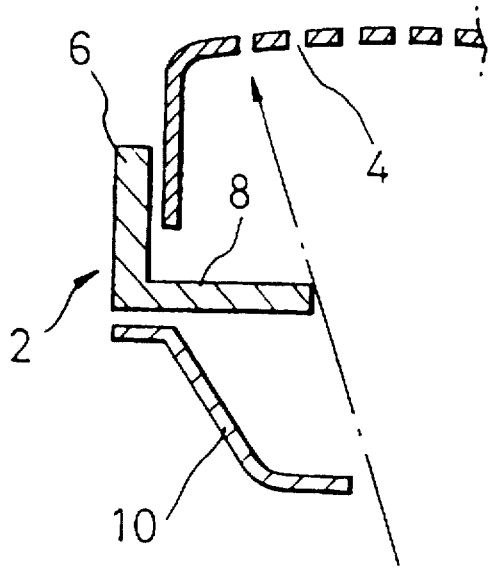
FIG. 6 PRIOR ART
FIG. 6 is a partly side-sectional view of a mask frame assembly according to a first preferred embodiment of the prior invention.
Figure 7:
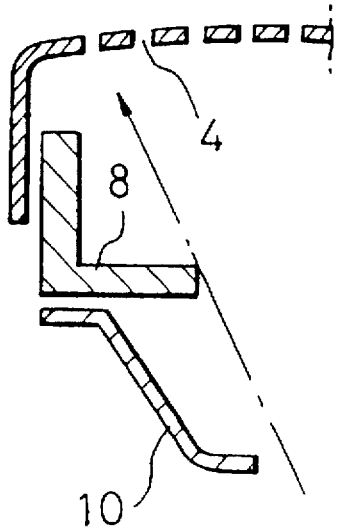
FIG. 7 PRIOR ART
FIG. 7 is a partial side-sectional view of a mask frame assembly according to a second preferred embodiment of the prior invention.

As illustrated in FIGS. 4 and 5, the side 30 is extended to the front end of the mask frame 24 so that the plate 34 for preventing random reflection is placed at front end of the mask frame 24 and limits the path of electron beams.

The assembly of the above structure has the advantage of allowing shorter length plates 34 for preventing reflection than the above applicable example.

Furthermore, the above structure has features that makes it easier to bend the thick mask frame, and it realizes a cost reduction.

While this invention has been described in connection with what is presently considered to be the most practical and preferred embodiments, it is to be understood that the invention is not limited to the disclosed embodiment, but, on the contrary, it is intended to cover various modifications and equivalent arrangements included within the spirit and scope of the appended claims.

What is claimed is:

1. A mask frame and inner shield assembly for a color cathode-ray tube comprising:

a band shaped mask frame without a flange portion extending from an end thereof; and an inner shield attached to the mask frame for shielding electron beams from the earth's magnetic field, the inner shield having an inwardly extending plate for preventing random reflection of the electron beams.

2. The mask frame and inner shield assembly for a color cathode-ray tube of claim 1 wherein the plate for preventing random reflection is formed integrally with the inner shield.

3. The mask frame and inner shield assembly for a color cathode-ray tube of claim 1 wherein the inner shield is attached to an inside or outside of the mask frame.

4. The mask frame and inner shield assembly for a color cathode-ray tube of claim 1 wherein the plate for preventing random reflection is inwardly extended from the inner shield in a front or rear end of the mask frame.

5. A mask frame and inner shield assembly for a color cathode-ray tube comprising:

a mask frame having an inner surface; and an inner shield attached to the mask frame for shielding electron beams from the earth's magnetic field, the inner shield having an inwardly extending plate for preventing random reflection of the electron beams, said plate extending further inward than the inner surface of the mask frame.

* * * * *